US006065671A

United States Patent [19]

Stepleton

[11] Patent Number: 6,065,671

[45] Date of Patent: May 23, 2000

[54] ROADSIDE MAILBOX MAIL DELIVERY SIGNAL

[76] Inventor: Frank Stepleton, 27486 Cross La., Barnett, Mo. 65011

[21] Appl. No.: 09/210,677

[22] Filed: Dec. 14, 1998

[51] Int. Cl.[7] ..... B65D 91/00

[52] U.S. Cl. ..... 232/35

[58] Field of Search ..... 232/35, 34, 17, 232/45; 116/200, 330, 333, 173

[56] References Cited

U.S. PATENT DOCUMENTS

| | | | |
|---|---|---|---|
| 2,483,992 | 10/1949 | Young . | |
| 2,730,298 | 1/1956 | Haserodt | 232/35 |
| 2,874,895 | 2/1959 | Opp et al. | 232/35 |
| 3,102,684 | 9/1963 | Eging | 232/35 |
| 3,338,511 | 8/1967 | Cvar | 232/35 |
| 3,968,928 | 7/1976 | Caldwell . | |
| 4,473,182 | 9/1984 | Dion . | |
| 4,811,895 | 3/1989 | Reinebach . | |
| 4,840,307 | 6/1989 | Hartman . | |

*Primary Examiner*—Terry Lee Melius
*Assistant Examiner*—William L. Miller

[57] ABSTRACT

A roadside mailbox mail delivered indicator is formed by a base flatly attachable to the horizontal top of the mailbox adjacent its door closed end opening, including a planar signal panel pivotly connected to one end of an upstanding portion of the base. A latch tip on the end portion of the signal panel opposite its hinged connection with the base, maintains the signal panel in a horizontal forward position by the mailbox door flange overriding the tip to hold the signal panel in a first cocked position. Opening the mailbox door releases the signal panel to a gravity pivoted upright second position for indicating mail delivery by the postman.

2 Claims, 2 Drawing Sheets

ROADSIDE MAILBOX MAIL DELIVERY SIGNAL

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to roadside mailboxes and more particularly to a visual signal indicating delivered mail.

1. Field of the Invention

One of the inconveniences of a roadside mailbox is knowing when the postman has delivered mail. It is desirable that a remotely visible flag or some similar signal be automatically displayed in response to the door being opened by the postman in depositing mail therein.

More particularly this device should not require any action on the part of the postman but be automatically actuated when the mailbox door is opened.

2. Description of the Prior Art

Prior art discloses an assortment of signal accessories for indicating postman opening of a mailbox in delivering mail, however, most of these devices are not easily installed in that they require mailbox modification such as the use of brackets, drilling of holes in the wall or walls of the mailbox, using brackets or latches which complicate both installation and the function of the devices.

The most pertinent prior patent is believed to be U.S. Pat. No. 4,840,307 issued Jun. 20, 1989 to Hartman for Postbox Signal. This patent discloses two principal components, one being a base attached by one end portion to the mailbox latch member for holding the base in place and providing hinge pin tabs at its opposite end cooperatively receiving similar tabs on the other planar signal member of the device. The signal member is maintained in cocked position by the closed mailbox door and is biased to an upright signal position by a spring surrounding the hinge pin.

U.S. Pat. No. 4,473,182 issued Sep. 25, 1984 to Dion for Signal Indicator For Mailboxes And The Like discloses a bracket transversely secured to the upper surface of a mailbox. Upstanding bracket arms journal tabs on a signal plate for pivoting movement of the plate about the horizontal axis of the hinge. The plate has an arm engageable with the door-closing latch of the mailbox to hold the signal plate in a horizontal cocked position. A counterweight on the opposite end portion of the plate biases the signal plate to an upstanding position when the mailbox door is opened.

U.S. Pat. Nos. 3,968,928 issued Jul. 13, 1976 to Caldwell for Mailbox Rotatable Signal and 4,811,895 issued Mar. 14, 1989 to Reinebach for Mailbox Signaling Device are believed good examples of the further state-of-the-art. Each of these patents principally disclose a signal arm pivotally mounted to one depending side portion of the mailbox for vertical pivoting movement of the signal arm about a horizontal axis with the signal arm held in a downward or cocked position by the mailbox door. When the door is opened the arm is released and biased upwardly to a signal position. In its cocked position the Caldwell planar signal device is oriented to normally face edgewise toward the homeowner but is rotated substantially 90° by the opening of the mailbox door to provide maximum visibility that the mailbox door has been opened. The Reinebach signal apparatus is biased from a substantially horizontal cocked position to an upright signaling position by a counterweight attached to one end portion of the arm released by the opening of the mailbox door.

This invention is believed distinctive over the above named patents and other similar art by providing a mailbox signal device readily secured by a base member to the upper surface of a mailbox without mutilation thereof and in which a signal member of the device is gravity pivoted about a horizontal hinge axis common to both members, and cooperatively formed by the two members. The signal device being maintained in a cocked position by the closing of the mailbox door.

BRIEF SUMMARY OF THE INVENTION

An elongated strap-like base member is provided with a bifurcated portion for impingment against the top surface of a mailbox by respective marginal edge portions of a mailbox door-closed latch. The other end portion of the base is turned orthogonally upright and horizontally rearwardly and is doubled back upon itself and loosely received by a cooperating slot transversely formed in one end portion of a planar signal panel permitting vertical movement toward and away from the top of the mailbox in a hinge-like fashion. The other end portion of the signal panel is provided with a latching tab which underlies the mailbox door flange when the door is in closed position to maintain the signal panel in a substantially horizontal cocked position. The hinged end portion of the signal panel surrounds a cylindrical counterweight which biases the signal member to an upright visible position when released by opening movement of the mailbox door.

The principal object of this invention is to provide a mailbox mail delivered signal which is easily attached to a conventional roadside mailbox without modification thereof and is pleasing in design, inexpensive and easily manufactured from conventional low mass sheet material and has a long useful life.

DETAILED DESCRIPTION OF THE INVENTION

Figure 1:
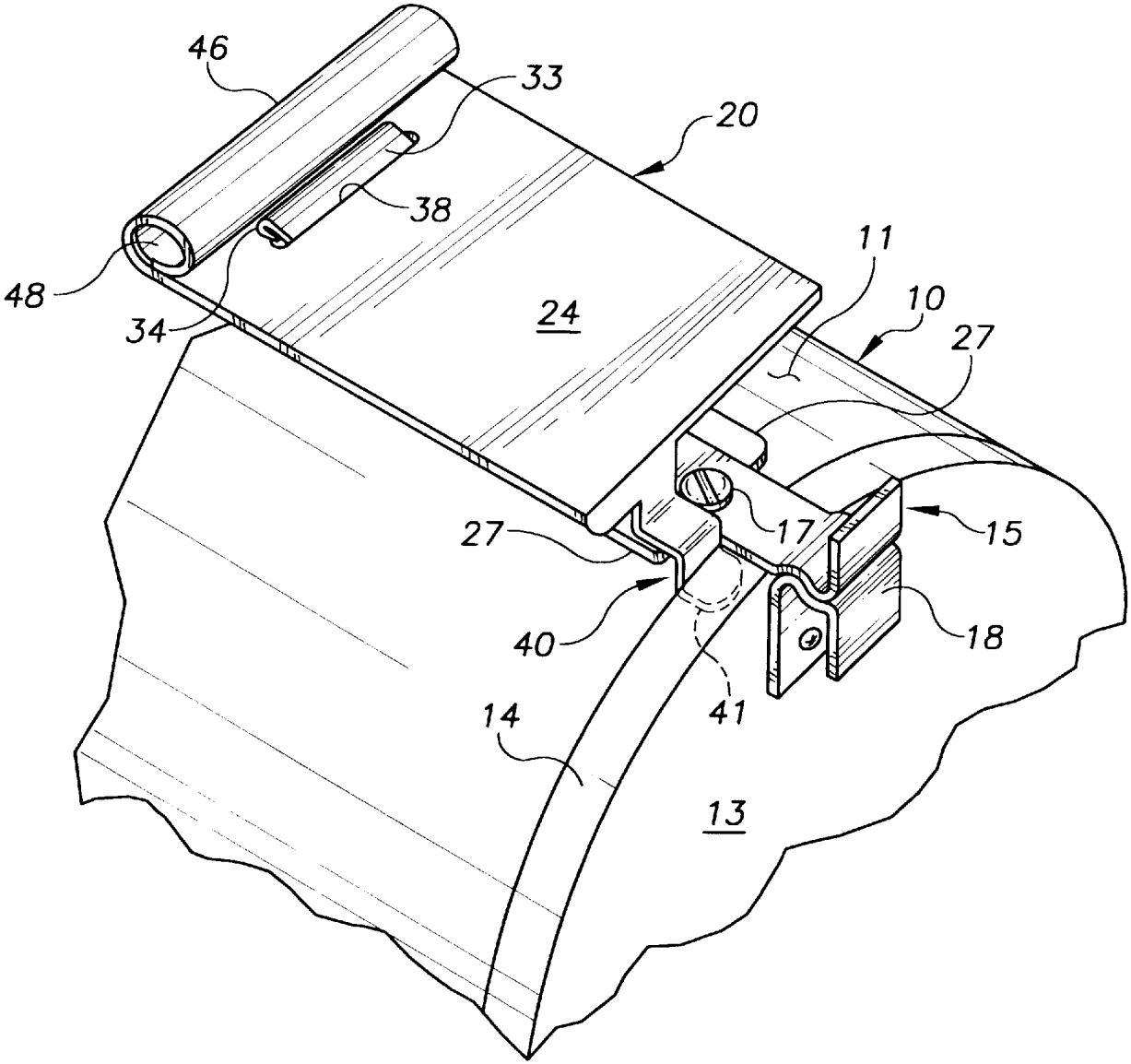
FIG. 1 is a fragmentary perspective view illustrating the device in operative cocked position.

Like characters of reference designate like parts in those figures of the drawings in which they occur.

In the drawings:

The reference numeral 10 indicates a substantially conventional roadside mailbox having an inverted U-shaped body including an arcuate transversely convex top surface 11. The body is closed by a horizontal bottom and a vertical wall at one end, neither being shown. The other end portion of the mailbox body defines a forward opening 12 normally closed by a door 13 moving vertically about a horizontal hinge axis, not shown, and includes a flange 14 on the bight portion of its inverted U-shaped edge which, when in door closed position, freely overlies a marginal edge portion of the adjacent open end surface of the mailbox body.

A mailbox latch 15 comprising an elongated strap metal member 16 is longitudinally secured by one end portion to the upper surface 11 of the mailbox by screws, bolts and nuts 17 or rivets, and projects forwardly beyond the mailbox open end. The door 13 further includes a handle 18 normally underlying and frictionally engaging the mailbox latch 15 when the door is in closed position, the handle being similarly secured to the forward surface of the mailbox 13.

The reference numeral 20 indicates the signal device which comprises a base 22 and a generally rectangular vertically pivoting panel or signal member 24 both preferably formed from relatively thin metallic material such as aluminum capable returning to a position of repose when bent or deflected less than its elastic limit. The base 22 is strap-like having a bifurcated end portion forming base arms 27 and an elongated slot 26 so that the base arms may be impinged on the top surface 11 under lateral marginal edge portions of the mailbox latch 15 by loosening the bolts 17 slightly, inserting the bifurcated end portion of the base under the latch marginal side edges and retightening the bolts.

Figure 3:
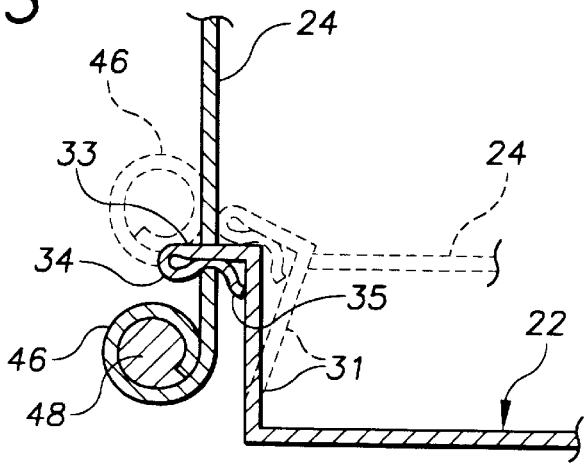

The other end portion of the base 22 is turned orthogonally upward, as at 30, to form a short wall portion 31 and angularly generally horizontal rearwardly, as at 32, to form a relatively short length flap portion 33 for freely entering a transverse slot 38 formed in one end portion of the signal panel 24. Medially its length, the flap 33 is doubled back upon itself (FIG. 3) before being inserted into the slot 38. The doubled back end portion of the flap 33 is spread apart to form a loop 34 of greater transverse section area than the transverse dimension of the slot 38 to maintain the signal panel on the flap. The flap free end portion 35 is angularly bent downwardly, as viewed in FIG. 3, between the vertical plane of the signal panel 24 and the base upright wall 31 to lock the signal panel on the flap 33, thus hingedly securing the signal panel to the base, and forming a horizontal hinge axis for vertical pivoting movement of the signal panel toward and away from the base and top surface 11 of the mailbox, for the purposes presently explained.

The signal panel 24 is generally rectangular planar. The upstanding end portion of the signal panel as viewed in FIG. 2, is provided with an orthogonally disposed, generally horizontal offset latch 40 terminating in a forwardly extending substantially semicircular tip 41, as viewed in FIG. 1, which underlies and is impinged on the mailbox top surface 11 by the door flange 14 when the door 13 is in closed position, thus securing the signal panel in a first folded or cocked substantially horizontal position above the mailbox 10.

The opposite end of the signal panel 24 is arcuately curved upon itself to form a transverse cylindrical tube or sleeve 46 for containing a counterweight 48, such as a length of concrete reinforcing bar, for gravity pivoting the signal panel 24 to a second upright signaling position (FIG. 2) when the mailbox lid 13 is opened by a postman placing mail in the mailbox. One or both planar surfaces of the panel between its slot 38 and the latch attached end portion is preferably provided with a bright color, such as red.

OPERATION

Figure 2:
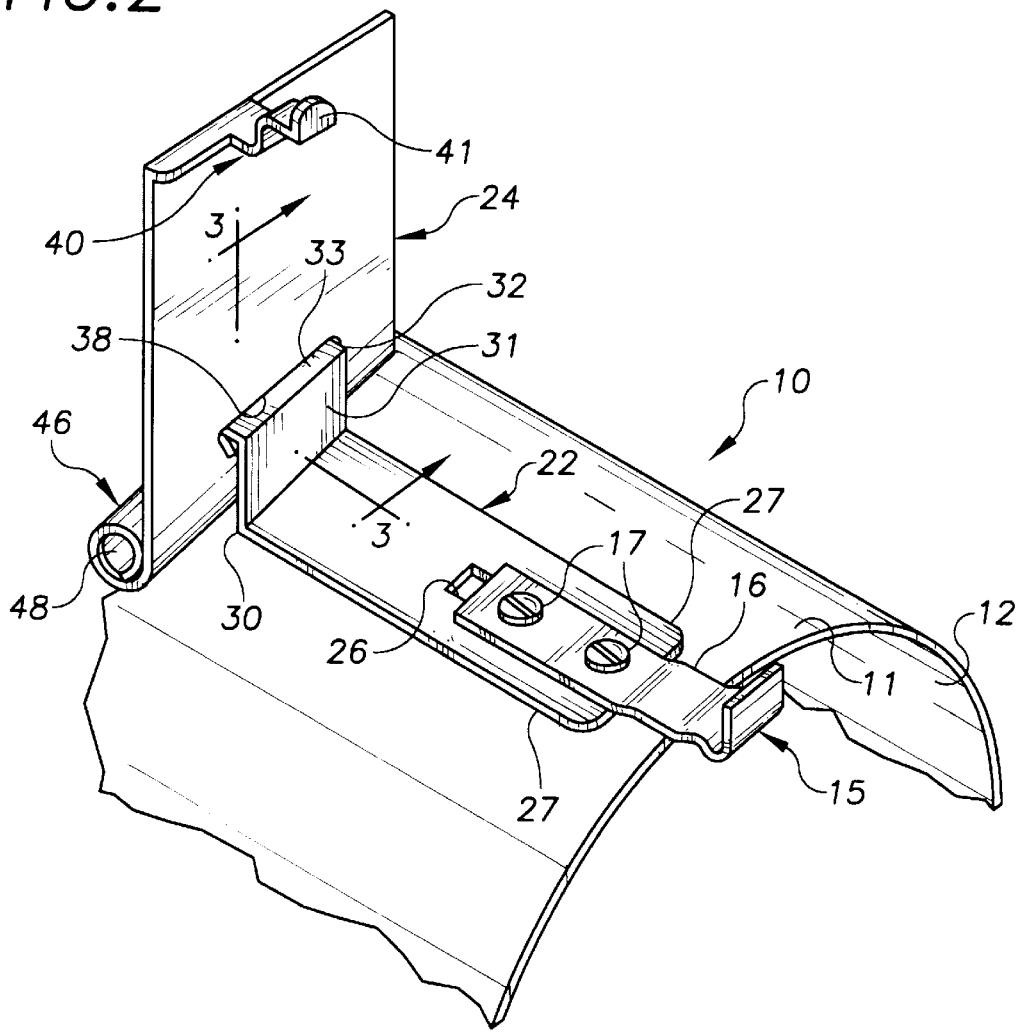
FIG. 2 is a similar perspective view illustrating the released visual signaling member in upright position; and, FIG. 3 is a fragmentary vertical cross sectional view, to a different scale, taken substantially along the line 3—3 of FIG. 2.

After the homeowner picks up delivered mail, he lowers the panel 24 to the position illustrated by FIG. 1, and closes the mailbox door 13 being sure that the door flange 14 impinges the latch 41 maintain the signal panel in cocked position. As mentioned hereinabove, the signal panel remains in this position until the postman opens the mailbox door 13 to release the latch 41 allowing the counterweight 48 to pivot the signal panel to the position of FIG. 2.

Obviously the invention is susceptible to changes or alterations without defeating its practicability. Therefore, I do not wish to be confined to the preferred embodiment shown in the drawings and described herein.

I claim:

1. A device for signalling the delivery of mail in a conventional roadside mailbox having an elongate top surface adjacent an opening opened and closed by a flanged edge door and having an elongated door latch longitudinally secured to the top surface, the improvement comprising:

an elongated planar base having a bifurcated end portion forming base arms for impingement on said top surface by lateral marginal portions of one end portion of the mailbox door latch, the other end portion of said base orthogonally disposed upright from the plane of said base bifurcated end portion and terminating in a generally horizontal doubled back upon itself end portion extending opposite said bifurcated end portion;

a signal panel having opposing sides and end portions and having a transverse slot medially the signal panel sides adjacent one end portion of said panel end portions for loosely receiving said base doubled back end portion and forming a horizontal hinge axis for vertical pivoting movement of the signal panel respective end portions toward and away from the top surface of the mailbox from a first generally horizontal folded position overlying in vertical spaced relation the base arms impinged end portion to a second upright mail delivered signal position, said signal panel one end portion extending beyond the slot forming an open end sleeve;

a counterweight of predetermined mass secured within said sleeve;

a release tab on the signal panel end portion opposite the sleeve orthogonally projecting toward the mailbox top surface when said signal panel is in said first position and terminating in a horizontal tip impinged on the mailbox top surface by the mailbox door flanged edge.

2. A device for signalling the delivery of mail in a conventional roadside mailbox having a door latch on a top surface and a door closed mail receiving opening, the improvement comprising:

an elongated planar base having a bifurcated end portion adapted for securement on the top surface of the conventional roadside mailbox adjacent the door closed mail receiving opening by a portion of the mailbox door latch, the other end portion of said base orthogonally disposed upright from the plane of said base-bifurcated end portion and terminating in a generally horizontal doubled back upon itself portion extending opposite said bifurcated end portion;

a signal panel having opposing sides and end portions and having a transverse slot medially the signal panel sides adjacent one end portion of said panel end portions for loosely achieving said doubled back portion forming a hinge axis for vertical pivoting movement of the signal panel respective end portions toward and away from the top surface of the mailbox from a first generally horizontal folded position overlying the base bifurcated end portion to a second upright mail delivered signal position;

a counterweight secured to said one end portion extending beyond the slot; and, a signal panel release tab on the end portion opposite the counterweight orthogonally projecting toward the mailbox top surface when said signal panel is in said first position and terminating in a horizontal tip impinged on the mailbox top surface when in said first position by the mailbox door when closed.

* * * * *